US005089064A

United States Patent [19]

Reghi

[11] Patent Number: 5,089,064

[45] Date of Patent: Feb. 18, 1992

[54] PROCESS FOR CORROSION RESISTING TREATMENTS FOR ALUMINUM SURFACES

[75] Inventor: Gary A. Reghi, Rochester Hills, Mich.

[73] Assignee: Henkel Corporation, Ambler, Pa.

[21] Appl. No.: 608,519

[22] Filed: Nov. 2, 1990

[51] Int. Cl.[5] ..... C23F 11/18; C23F 11/14; C23F 11/00

[52] U.S. Cl. ..... 148/247; 427/444; 427/430.1; 427/435; 427/428; 427/427; 427/421

[58] Field of Search ..... 422/12, 16, 18, 19; 427/421, 427, 428, 430.1, 444, 388.1, 435; 252/389.31 APS, 389.3 APS, 393 APS, 400.3 APS, 404 APS; 148/247; 106/14.14, 14.21

[56] References Cited

U.S. PATENT DOCUMENTS

| | | | |
|---|---|---|---|
| 4,277,292 | 7/1981 | Tupper | 148/247 |
| 4,313,769 | 2/1982 | Frelin et al. | 148/247 |
| 4,341,558 | 7/1982 | Yarshiro et al. | 148/247 |
| 4,517,028 | 5/1985 | Lindert | 148/6.14 R |

FOREIGN PATENT DOCUMENTS

| | | |
|---|---|---|
| 0008942 | 3/1980 | European Pat. Off. . |
| 2165165A | 4/1986 | United Kingdom . |

*Primary Examiner*—Robert L. Stoll
*Assistant Examiner*—Valerie Fee
*Attorney, Agent, or Firm*—Ernest G. Szoke; Wayne C. Jaeschke; Norvell E. Wisdom, Jr.

[57] ABSTRACT

An exceptionally effective chromium free corrosion protective surface treatment composition for aluminum and its alloys is an aqueous acidic liquid comprising water and: (A) from about 0.8 to about 1.2 w/o of $H_2ZrF_6$; (B) from about 0.08 to about 0.12 w/o of dispersed silica; (C) from about 0.08 to about 0.12 w/o of a water soluble or dispersible polymer of 3-(N-methyl-N-2-hydroxyethylaminomethyl)-4-hydroxystyrene; and (D) from 0.10 - 0.15 w/o of 1-propoxy-2-propanol. The surface to be treated is contacted with the composition and then dried without rinsing. A conventional organic coating may advantageously be applied over the surface produced by this treatment.

10 Claims, No Drawings

PROCESS FOR CORROSION RESISTING TREATMENTS FOR ALUMINUM SURFACES

BACKGROUND OF THE INVENTION

1. Field of the Invention

This invention relates to a composition and process for treating the surface of aluminum objects to improve their resistance to corrosion, either as treated, or more particularly after subsequent painting or similar coating with an organic protective layer. The invention is applicable to any surface that consists predominantly of aluminum (hereinafter denoted as an "aluminous surface") and is especially suited to various commercial aluminum alloys, such as Types 3003, 3004, 3104, 3105, 182, 5050, and 5352, but is not limited to these particular alloys. The composition of the invention is substantially or entirely free from chromium and therefore less polluting than the now common commercial chromating treatment for the same purpose.

2.Statement of Related Art

Numerous compositions and processes for treating aluminous surfaces are currently known in the art. Where maximum corrosion protection of aluminous surfaces is dechromium containing surface treatment compositions with an associated pollution potential.

The prior art which is believed most closely related to the present invention is that teaching surface treatment of metals with polymers of vinyl phenols. The phenols optionally have various additional functional groups on the aromatic rings of the polymer, including amine and substituted amine groups. U.S. Pat. No. 4,517,028 of May 14, 1985 to Lindert et al. is an example of this related prior art.

DESCRIPTION OF THE INVENTION

Except in the claims and the operating examples, or where otherwise expressly indicated, all numbers in this description indicating amounts of material or conditions of reaction and/or use are to be understood as modified by the word "about" in describing the broadest scope of the invention. Practice within the exact numerical limits stated is generally preferred.

SUMMARY OF THE INVENTION

It has been found that a particular combination of ingredients gives superior corrosion protective effect on aluminum surfaces. One embodiment of a composition according to this invention, specifically a composition suited for use as such in treating aluminous surfaces, is an acidic aqueous solution and comprises, or preferably consists essentially of, water and:

(A) from 0.01 to 18 percent by weight ("w/o"), preferably from 0.5 to 5.0 w/o, or more preferably from 0.8 to 1.2 w/o, of dihydrogen hexafluorozirconate (IV), having the chemical formula $H_2ZrF_6$ and also known as fluozirconic acid; and (B) from 0.01 to 10 w/o, preferably from 0.05 to 0.5 w/o, or more preferably from 0.08–0.12 w/o, of a water soluble or dispersible polymer of 3-(N-$C_{1-4}$alkyl-N-2-hydroxyethylaminomethyl)-4-hydroxystyrene; and, optionally but preferably, (C) from 0.05 to 10 w/o, preferably from 0.05–0.5 w/o, more preferably from 0.08–0.12 w/o, of dispersed silica, preferably colloidal silica; and (D) from 0.06 to 0.6 w/o, preferably from 0.0–0.1–0.15 w/o, of a solvent other than water that (i) can dissolve at a temperature not greater than 50° C. a sufficient amount of a homopolymer of 4-hydroxy-styrene having an average molecular weight in the range of 3000–6000 to produce a solution containing at least 20, or preferably at least 50, grams of polymer per liter of solution and (ii) is itself sufficiently soluble in water at a temperature not greater than 50° C. to produce a solution containing at least 1, preferably at least 5, grams of solvent per liter of aqueous solution, and, optionally but not necessarily preferably, (E) surfactant in an amount effective to reduce the surface tension of the composition.

The molecular weight of the polymer component (B) is preferably from 700 to 200,000 or more preferably from 1200 to 70,000, still more preferably from 4900 to 9800.

The polymer component (B) described above need not be a homopolymer. In fact, the most preferred polymer component is one made by reacting a commercially available polymer of 4-vinyl phenol with formaldehyde and 2-alkylamino-1-ethanol, to add an N-alkyl-N-2-hydroxyethylaminomethyl substituent to most of the phenolic rings; it is unlikely that all of the rings can be substituted, and possible that some of the rings will have two substituents. However, it is preferred that the polymer component (C) contain at least 35 number %, or more preferably at least 75 number %, of monomer units with the structure:

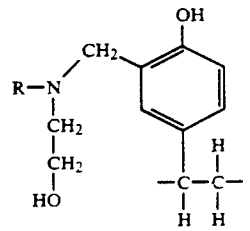

where R is a straight or branched alkyl group having up to four carbon atoms, that would be expected theoretically in a homopolymer of a 3-(N-alkyl-N-2-hydroxyethylaminomethyl)-4-hydroxystyrene. A methyl group is preferred for R in the formula above, but ethyl, propyl, and/or butyl groups may be substituted for some or all of the methyl groups in the above formula with little difference in the results in most cases, and even totally different substituents on the phenolic rings, of the polymer, as described in U.S. Pat. No. 4,517,028, are also effective.

The optional solvent component (D) as described above preferably is selected from the group of organic solvents containing at least one ether oxygen atom, at least one hydroxyl group, and not more than 10, preferably not more than 6, carbon atoms in each molecule. The most preferred solvent is 1-propoxy-2-propanol.

It should be understood that the above description of a composition according to the invention is not intended to imply that there may not be chemical interactions among the components specified in the composition. The description refers to the components as added and does not exclude new chemical entities that may be formed by interaction in the composition.

Another embodiment of the invention comprises an aqueous concentrate that can be diluted with water only to produce a composition as given above ready for use as such in treating aluminous surfaces. Concentrates that include silica are usually stable for only a few days, so that when concentrates are intended for long term storage, silica should not be included in the principal concentrate. If silica is desired at the time of use, as is generally highly preferred, it can be added conveniently from a separate concentrate of suitable silica dispersed in water, along with whatever additional water is to be added to make the working composition from the concentrate(s).

A process according to this invention comprises at least steps of contacting an aluminous surface with a composition according to the invention and then drying without any intermediate rinsing, contacting between the surface and the liquid composition according to the invention may be accomplished by any convenient method, such as immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between rolls, and the like. Drying also may by accomplished by any convenient method, such as a hot air oven, exposure to infra-red radiation, microwave heating, and the like.

The temperature during contact between a composition according to the invention and an aluminous surface to be treated is not at all critical. Prevailing ambient temperature is most convenient, but the temperature may range from just above the freezing point to just below the boiling point of the liquid composition. Generally, for convenience and economy, temperatures between 20° and 70° C. are preferred, with those between 25° and 35 ° C. more preferred.

The amount of liquid composition retained on the treated surface after drying may conveniently be measured by X-ray induced emission spectroscopy, for example by using a PORTASPEC TM Model 2501 apparatus available from Cianflone Scientific Company, Pittsburgh, Pa., USA. In this apparatus, there is an X-ray tube which emits a beam of primary radiation onto the sample to be analyzed. The primary radiation causes the atoms in at least the surface region of the sample to emit secondary fluorescent radiation which contains lines characteristic for each element present in the emitting region. This secondary radiation is directed through a collimator onto a large single crystal within the apparatus The single crystal acts as a diffraction grating to separate the various wavelengths present in the secondary radiation. The entire angular range of the diffracted secondary radiation emitted from the sample is scanned by a detector in the apparatus and may be read as "counts" on a meter that is also part of the apparatus. The intensity of the radiation at the wavelength characteristic of zirconium is, with suitable corrections, proportional to the number of zirconium nuclei within the emitting region of the sample. In practice, the counts indicated by the apparatus were used directly as the measure of the amount of zirconium present, after standardization as follows:

The selector arm of the instrument is moved to the zirconium position and used to count for 25 seconds the secondary fluorescence from a sample of a metal alloy known to be at least about 95 % pure zirconium. The milliamp output control on the instrument is adjusted if necessary until the number of counts in 25 seconds from such a zirconium alloy sample is within the range 736,000±3000 as the average of at least four measurements. The counts are taken from a circular area 2.6 cm in diameter, with the primary radiation from the instrument focussed at the center of the circle. The same settings of the instrument controls and the same sample size are then retained for the measurements described below.

Normally an aluminum alloy surface even before treatment will have some zirconium counts detectable by this method, so that a blank value should be determined. Preferably the amount of composition retained, after treatment and drying according to this invention is sufficient to increase the surface counts of zirconium by an amount from 80 to 1300 counts, or more preferably from 300 to 600 counts for 25 seconds total counting time, using the same sample size, instrument settings, and minimum number of replicate measurements to establish the average value as are described for standardization above.

Preferably, the aluminous surface to be treated according to the invention is first cleaned of any contaminants, particularly organic contaminants and foreign metal inclusions. Most preferably, the surface to be treated is first contacted with a conventional hot alkaline cleaner, then rinsed in hot water, then contacted with a neutralizing acid rinse, then, rinsed cold water and subsequently dried, before being contacted with a composition according to the invention as described above.

The invention is particularly well adapted to treating surfaces that are to be subsequently further protected by applying conventional organic protective coatings over the surface produced by treatment according to the invention.

The practice of this invention may be further appreciated by consideration of the following, non-limiting, working examples.

EXAMPLE 1

A highly preferred composition according to the invention was prepared by the process described below.

An amount of 425 parts by weight ("PBW") of liquid 1-propoxy-2-propanol, commercially available as "PROPASOL TM Solvent P" from Union Carbide Corp., was introduced into a reactor vessel equipped with a stirrer and a reflux condenser. Then 240 PBW of solid powdered poly{4-hydroxystyrene} was dissolved in the previously added liquid. The solid polymer used was RESIN M TM, commercially supplied by Maruzen Oil Co., Ltd. of Tokyo, Japan. This polymer is reported by its supplier to have a molecular weight of 3000–6000, to contain no more than 1 w/o residual 4-hydroxystyrene monomer, and to have a solubility of at least 5 grams per 100 milliliters ("ml") of ethylene glycol monobutyl ether ("Butyl CELLOSOLVE TM"). This mixture was then heated to about 80° C. with stirring and reflux of solvent and held at that temperature for one hour to insure complete solubility of the added polymer.

The solution of polymer was then cooled to a temperature within the range of 45°–50 ° C., and 151.7 PBW of N-methyl ethanolamine was added to the solution, followed by 480 PBW of deionized water. Then 163.4 PBW of an aqueous solution of formaldehyde containing 36.75 w/o of pure formaldehyde was added to the mixture of the other ingredients over a period of about 45 minutes. The mixture was then held, with stirring, at a temperature within the range of 45°-50 ° C. for two hours after the last addition of formaldehyde. The mixture was then heated to about 80° C. and held at that temperature for four hours. The mixture was then cooled below 45° C., and an additional 85 PBW of PROPASOL TM P was added to it, to produce a final polymer dispersion with a total solids content of 26.75 % by weight.

A working composition according to the invention was then prepared by adding in succession, to 482 PBW of deionized water, 12 PBW of an aqueous solution of fluozirconic acid containing 40 w/o of pure $H_2ZrF_6$, 2 PBW of the above noted final polymer dispersion, and 4 PBW of CABOSPERSE TM A-205, a dispersion of colloidal silica in water containing about 12 w/o silica and commercially available from the Cabot Corporation. The composition prepared in this way may be used directly as a highly satisfactory composition for treatments according to this invention.

The directions given above may be varied in ways apparent to those skilled in the art to prepare alternative compositions, for example compositions with different proportions among the various components, and other solvents than the one specified above may be used for the initial dissolution of the polymer of 4-vinyl phenol. To assure optimally complete reaction, it has been found advisable to test for free formaldehyde on small samples of the reaction mixture during the aminatron of the polymer as described above, when such a reaction is used, and to continue heating the reaction mixture at or about 80 ° C. for at least one hour after the free formaldehyde value in the mixture has fallen to or below 0.3 w/o. Such a value would be found after three hours, for example, under the exact reaction conditions described above. A determination of free formaldehyde may be made by the following procedure:

1. Introduce a 10.0 ml sample of the mixture into a 150 ml beaker provided with a magnetic stirring bar.
2. While stirring rapidly, add 90 ml of deionized water slowly, to precipitate organic polymer content. Stir to break up any clumps of precipitate. Separate precipitate from supernatant liquid by filtration and transfer 25.0 ml of filtrate to another beaker of 150-250 ml capacity. The filtrate may be amber colored but should not be cloudy. Add several drops of thymolphthalein indicator solution to produce a blue color and titrate with 0.10 N sulfuric acid to disappearance of the blue color.
3. Add 50 ml of 1 M sodium thiosulfate solution and mix. Sample color will return to blue. Titrate again with 0.1 N sulfuric acid to the same color end point as reached in step 2. Record ml required to end point as "V".
4. Mix 25 ml of deionized water with 50 ml of the same lot of 1 M sodium thiosulfate solution as used in step 3, add thymolphthalein indicator as in step 2, and titrate with 0.1 N sulfuric acid to a colorless end point (disappearance of blue initial color). Record ml required to end point as "B".
5. Calculate w/o formaldehyde=0.12(V-B).

EXAMPLES 2-5

These are examples of a process according to the invention, and include examples of compositions according to the invention. For all these examples, rectangular sheet samples of 5352 aluminum alloy with a thickness of 0.18 mm were subjected to the following process sequence:

1. Spray for 10 seconds ("sec") at 52°-54 ° C. with a conventional aqueous alkaline cleaning solution containing alkali metal hydroxide, alkali phosphate, sodium gluconate, and surfactants and having a pH value of about 13.

Rinse with hot water for 5 sec.

3. Spray for 3 sec at 43° C. with aqueous sulfuric acid at a dilution to give a pH value of 2.25.
4. Rinse with cold water for 5 sec.
5. Dry with rubber squeegee.
6. Contact with composition according to the invention, using grooved rubber squeegee rolls.
7. Dry in oven with infra-red radiators.
8. Coat dried samples with conventional paint or other organic protective coating.

The compositions used in step 6 were prepared in the same general manner as described in Example 1, but the amounts of reagents in the final mixing step were varied to give the final compositions for treatment as shown in Table 1.

TABLE 1

TREATMENT COMPOSITIONS FOR EXAMPLES 2-5

| | PBW per 500 PBW of Total Composition[1] of: | | |
|---|---|---|---|
| Example No. | 40 w/o $H_2ZrF_6$ | Polymer Dispersion[2] | CABOSPERSE TM A-205 |
| 2 | 12 | 1 | 4 |
| 3 | 12 | 2 | 2 |
| 4[3] | 12 | 2 | 4 |
| 5 | 12 | 5 | 2 |

Notes for Table 1
[1]The balance of the compositions was always deionized water.
[2]This dispersion is the same as the "final polymer dispersion" described in Example 1.
[3]This composition is the same as the composition according to the invention described in Example 1.

The treated and dried samples were then painted with one of the two VALSPAR TM paints, items S-9009-139 or S-9009-141, according to the supplier's direction. Both of these types of paint are vinyl based and are recommended for the interior of cans for food. Painted duplicate samples were subjected to corrosion testing, with results as shown in Table 2. The "O-T" test was performed by first bending the painted sheet sample like a sheet of paper folded in half, causing the paint film on the outer surface of the panel to break along the line of the bend. Pressure sensitive tape (SCOTCH TM #610, commercially available from Minnesota Mining and Manufacturing Co.) was then pressed down firmly by hand over the flat part of the panel adjacent to the bend, with the line of the tape perpendicular to that of the bend.

The tape was then slowly peeled away from the area of the bend. The distance from the bend over which paint was removed was observed and reported according to the following scale: 5 =no detectable paint removal; 4 =paint removal from 1.59 mm from the bend up to 3.17; 3 =paint removal from 3.17 up to 4.76 mm; 2 =paint removal from 4.76 up to 6.35 mm; 1 =paint removal at least 6.35 mm from the bend. Intermediate degrees of removal are indicated by decimal numbers between the integers noted.

For the tests noted under the heading "90 Min Pressure Cooker", the painted samples were partly immersed in a conventional domestic pressure cooker containing tap water. The cooker was then closed and heated sufficiently to bring the steam pressure within the cooker to about 2 bars absolute, and these conditions within the cooker were maintained for 90 minutes. The cooker was then cooled and opened, and the samples were then removed and dried. The degree of blistering visually observed was recorded qualitatively, with a note as to whether there was a significant difference between the majority of the sample surface and the area near the corners of the sample.

TABLE 2

CORROSION TESTING RESULTS FOR EXAMPLES 2-5

| | | Corrosion Testing Results from: 90 Min Pressure Cooker | | |
|---|---|---|---|---|
| Example No. | Paint Type | 0-T | Cross Hatch | Surface Blisters |
| 2 | S-9009-139 | 5.0 | 9.7 | v.v.v. few/m. corn. |
| 2 | S-9009-139 | 5.0 | 9.7 | v.v. few |
| 3 | S-9009-139 | 5.0 | 9.7 | v.v. few/m. corn. |
| 3 | S-9009-139 | 4.5 | 9.6 | v.v. few |
| 4 | S-9009-139 | 5.0 | 9.8 | n./v.v. few corn. |
| 4 | S-9009-139 | 5.0 | 9.8 | n./v.v. few corn. |
| 5 | S-9009-139 | 4.5 | 9.7 | few |
| 5 | S-9009-139 | 4.0 | 9.9 | few |
| 2 | S-9009-141 | 5.0 | 9.8 | v.v.v. few |
| 2 | S-9009-141 | 5.0 | 9.9 | n. |
| 3 | S-9009-141 | 5.0 | 9.8 | v.v.v. few |
| 3 | S-9009-141 | 5.0 | 9.9 | v.v.v. few |
| 4 | S-9009-141 | 5.0 | 9.8 | n. |
| 4 | S-9009-141 | 5.0 | 9.8 | n. |
| 5 | S-9009-141 | 5.0 | 9.7 | v.v. few |
| 5 | S-9009-141 | 5.0 | 9.8 | v.v. few |

Notes for Table 2
"v." = very, "corn." = in area of corners; "m." = many; "n." = none. Details about test conditions are given in the main text.

On the same panels or other panels subjected to the same conditions, ten parallel cuts spaced 1.58 mm apart were made with a sharp knife near the center of the sample, sufficiently deep to cut through the paint film to the underlying metal, and then a second set of cuts of the same type and spacing were made perpendicular to the first set to create a cross-hatch pattern. Pressure sensitive adhesive tape of the same type as used for the "O-T" test was then applied over the cross hatch area and firmly pressed down by hand, then quickly peeled away. The amount of paint removed from the area of the cross hatch was visually estimated. A value of 10 corresponds to no paint removal by the tape, while a value of 9 indicates loss of the paint from about 10% of the painted area within the cross hatch pattern. Decimal values between 9 and 10 indicate intermediate values of paint removal, approximately 1% of area for each integer in the first decimal place. (I.e., 9.9= about 1 % removal, 9.7 =about 3% removal, 9.5 =about 5 % removal, etc.)

The values shown for all the examples in Table 2 would be acceptable for most intended uses of painted aluminum sheets. With the S-9009-39 paint the results are best overall for Example 4, but with the other paint shown all the Examples shown are about equal in quality, based on these tests.

EXAMPLES 6-9

These examples illustrate a concentrate according to this invention, a composition for use in a process according to this invention, and processes according to the invention.

The concentrate was prepared in the same general manner as shown in Example 1, using 120 PBW of fluozirconic acid, 20 PBW of the "final polymer dispersion" 40 w/o described in Example 1 above, 40 PBW of CABOSPERSE TM A-205, and 1820 PBW of deionized water. An amount of 41.1 PBW of this concentrate was mixed with 458.9 PBW of deionized water to form the working composition used in all these examples. Panels of type 5182 aluminum alloy, 0.28 mm thick, were then treated as for steps (1)-(2) and (5) - (8) of examples 2-5; the acid rinsing step (3) and subsequent cold water rinsing step (4) used in examples 2-5 were not used.

In step (8) the panels treated according to this invention were coated according to the manufacturer's directions with conventional commercial lacquers as follows:

| Example No. | Lacquer Supplier and Type No. |
|---|---|
| 6 | VALSPAR TM S-6839-020 |
| 7 | VALSPAR TM S-9835-002 |
| 8 | DEXTER MIDLAND TM 4820-A22M |
| 9 | DEXTER MIDLAND TM 8800-A03M |

The treated and lacquered panels were immersed in boiling tap water for 30 minutes, then removed and dried and tested for cross hatch adhesion, impact adhesion, and feathering adhesion. The cross hatch adhesion test was the same as for Examples 2-5. The value of "10" indicates perfect adhesion in the test. The impact adhesion test was performed according to the procedures of ASTM D 27941, using a 20 inch-pound impact. The feathering test was performed by ripping a panel along a line and inspecting the ripped edge for any lifting or feathering of the lacquer that may have occurred. In this test a value of 10 indicates no feathering, a value of 9.0 indicates feathering observable at least 0.1 but less than 0.2 mm away from the ripped edge, and a value of 9.5 indicates feathering observable only up to or less than 0.1 mm from the ripped edge. The results are shown in Table 3.

TABLE 3

ADHESION TEST RESULTS FOR EXAMPLES 6-9

| | Adhesion Test Rating from Test of: | | |
|---|---|---|---|
| Example No. | Cross Hatch | Feathering | Impact |
| 6 | 10 | 10.0 | 10 |
| 7 | 10 | 9.0 | 10 |
| 8 | 10 | 9.5 | 10 |
| 9 | 10 | 9.5 | 10 |

What is claimed is:

1. A process for improving the corrosion resistance of an article having an aluminum surface, comprising steps of:

(I) containing the aluminous surface with an aqueous liquid composition of matter comprising water and:

(A) from about 0.01 to about 18 w/o of $H_2ZrF_6$;

(B) from about 0.01 to about 10 w/o of a water soluble or dispersible polymer of 3-(N-$C_{1-4}$ alkyl-N-2-hydroxyethylaminomethyl)-4-hydroxystyrene; and (C) from about 0.05 to about 10 w/o of dispersed silica; and, optionally (D) from 0.06 to 0.06 w/o of a solvent other than water that (i) can dissolve at a temperature not greater than 50° C. a sufficient amount of a homopolymer of 4-hydroxy-styrene having an average molecular weight in the range of 3000-6000 to produce a solution containing at least 20 grams of polymer per liter of solution and (ii) is itself sufficiently soluble in water at a temperature not greater than 50° C. to produce a solution containing at least 1 grams of solvent per liter of aqueous solution; and, optionally, (E) surfactant in an amount effective to reduce the surface tension of the composition; and (II) drying without rinsing the surface contacted in step (I).

2. A process according to claim 1, comprising an additional step of covering the aluminous surface dried in step (II) with an organic protective coating.

3. A process according to claim 2, comprising additional steps of cleaning the aluminous surface by contact with a strong alkaline cleaner and subsequently rinsing the surface thus cleaned with a sufficiently acidic rinse to avoid the presence of any alkali on the surface before contacting the surface with said aqueous liquid composition.

4. A process according to claim 3, wherein said aqueous liquid composition comprises:

(A) from about 0.08 to about 1.2 w/o of $H_2ZrF_6$;

(B) from about 0.08 to about 0.12 w/o of a water soluble or dispersible polymer of 3-(N-methyl-N-2-hydroxyethylaminomethy)-4-hydroxystyrene; and (C) from about 0.08 to about 0.12 w/o of dispersed silica.

5. A process according to claim 2, wherein said aqueous liquid composition comprises:

(A) from about 0.8 to about 1.2 w/o of $H_2ZrF_6$;

(B) from about 0.08 to about 0.12 w/o of a water soluble or dispersible polymer of 3-(N-methyl-N-2-hydroxy-ethylaminomethyl)-4-hydroxystyrene; and (C) from about 0.08 to about 0.12 w/o of dispersed silica.

6. A process according to claim 1, wherein said aqueous liquid composition comprises:

(A) from about 0.8 to about 1.2 w/o of $H_2ZrF_6$;

(B) from about 0.8 to about 0.12 w/o of a water soluble or dispersible polymer of 3-(N-methyl-N-2-hydroxyethylaminomethyl)-4-hydroxystyrene; and (C) from about 0.08 to about 0.12 w/o of dispersed silica.

7. A process according to claim 6, wherein the polymer of 3-(N-methyl-N-2-hydroxyethylaminomethyl)-4-hydroxystyrene has been made by reacting a polymer of 4-vinyl phenol having an average molecular weight in the range from about 3000 to about 6000 with an amount of formaldehyde and of 2-methylamino-1-ethanol that is at least sufficient to provide one molecule of each of formaldehyde and of 2-methylamino-1-ethanol per phenyl ring in the amount of polymer of 4-vinyl phenol that is reacted and the aqueous liquid composition also comprises from 0.10–0.15 w/o of component (D).

8. A process according to claim 5, wherein the polymer of 3-(N-methyl-N-2-hydroxyethylaminomethyl)-4-hydroxystyrene has been made by reacting a polymer of 4-vinyl phenol having an average molecular weight in the range from about 3000 to about 6000 with an amount of formaldehyde and 2-methylamino-1-ethanol that is at least sufficient to provide one molecule of each of formaldehyde and of 2-methylamino-1-ethanol per phenyl ring in the amount of polymer of 4-vinyl phenol that is reacted and the aqueous liquid composition also comprises from 0.10–0.15 w/o of component (D).

9. A process according to claim 4, wherein the polymer of 3-(N-methyl-N-2-hydroxyethylaminomethyl)-4-hydroxystyrene has been made by reacting a polymer of 4-vinyl phenol having an average molecular weight in the range from about 3000 to about 6000 with an amount of formaldehyde and of 2-methylamino-1-ethanol that is at least sufficient to provide one molecule of each of formaldehyde and of 2-methylamino-1-ethanol per phenyl ring in the amount of polymer of 4-vinyl phenol that is reacted and the aqueous liquid composition also comprises from 0.10–0.15 w/o of component (D).

10. A process according to claim 1, wherein the polymer of 3-(N-methyl-N-2-hydroxyethylaminomethyl)-4-hydroxystyrene has been made by reacting a polymer of 4-vinyl phenol having an average molecular weight in the range from about 3000 to about 6000 with an amount of fomraldehyde and of 2-methylamino-1-ethanol that is at least sufficient to provide one molecule of each of formaldehyde and of 2-methylamino-1-ethanol per phenyl ring in the amount of polymer of 4-vinyl phenol that is reacted and the aqueous liquid composition also comprises from 0.10–0.15 w/o of component (D).

* * * * *